US008303728B2

(12) United States Patent
Peukert et al.

(10) Patent No.: US 8,303,728 B2
(45) Date of Patent: Nov. 6, 2012

(54) PASS-THROUGH DISHWASHER WITH CONTROLLED DRYING

(75) Inventors: Thomas Peukert, Oberkirch (DE); Bruno Gaus, Offenburg (DE)

(73) Assignee: Meiko Maschinenbau GmbH & Co. KG, Offenburg (DE)

( * ) Notice: Subject to any disclaimer, the term of this patent is extended or adjusted under 35 U.S.C. 154(b) by 797 days.

(21) Appl. No.: 12/105,763

(22) Filed: Apr. 18, 2008

(65) Prior Publication Data

US 2008/0257391 A1 Oct. 23, 2008

Related U.S. Application Data

(60) Provisional application No. 60/938,122, filed on May 15, 2007.

(30) Foreign Application Priority Data

Apr. 19, 2007 (DE) ..... 10 2007 018 447

(51) Int. Cl.
*A47L 15/24* (2006.01)
*A47L 15/48* (2006.01)

(52) U.S. Cl. ..... 134/57 D; 134/72

(58) Field of Classification Search ..... 134/25.2, 134/30, 57 D, 56 D, 58 D, 61, 71, 72, 124, 134/131

See application file for complete search history.

(56) References Cited

U.S. PATENT DOCUMENTS

| | | | | |
|---|---|---|---|---|
| 3,673,699 | A * | 7/1972 | Buffington | 34/66 |
| 4,270,283 | A * | 6/1981 | Ellis | 34/212 |
| 4,354,825 | A * | 10/1982 | Fisher et al. | 432/14 |
| 6,195,908 | B1 * | 3/2001 | Crul | 34/343 |
| 6,725,732 | B1 * | 4/2004 | Stein | 73/861.55 |
| 2007/0131260 | A1 * | 6/2007 | Scheringer et al. | 134/61 |
| 2008/0115807 | A1 * | 5/2008 | Gaus | 134/18 |
| 2008/0159907 | A1 * | 7/2008 | Joshi et al. | 422/5 |

FOREIGN PATENT DOCUMENTS

| | | | |
|---|---|---|---|
| DE | 10 2004 003 797 A1 | | 8/2005 |
| DE | 102004003797 | * | 8/2005 |
| WO | WO 2006097294 A1 | * | 9/2006 |

* cited by examiner

*Primary Examiner* — Joseph L Perrin
(74) *Attorney, Agent, or Firm* — Muncy, Geissler, Olds & Lowe, PLLC

(57) ABSTRACT

A pass-through dishwasher is provided having at least one washing zone, at least one rinsing zone and a drying zone. The pass-through dishwasher is used to clean items to be washed and comprises a conveyor device for conveying the items to be washed through successive treatment zones. The pass-through dishwasher comprises a drying zone which has arranged in it at least one drying fan whose rotation speed can be controlled.

15 Claims, 2 Drawing Sheets

PASS-THROUGH DISHWASHER WITH CONTROLLED DRYING

This nonprovisional application claims priority to German Patent Application No. 10 2007 018 447.8, which was filed in Germany on Apr. 19, 2007, and to U.S. Provisional Application No. 60/938,122, which was filed on May 15, 2007, and which are both herein incorporated by reference.

BACKGROUND OF THE INVENTION

1. Field of the Invention

The invention relates to a cleaning machine, in particular to a pass-through dishwasher, for items to be cleaned, for example dishes.

2. Description of the Background Art

Cleaning machines, in particular pass-through dishwashers, which are used, for example, to clean dishes, trays and containers which need to be cleaned having been used for communal purposes are known. Whereas dishwashers for the domestic field generally run through a program sequence comprising the successive cleaning steps with stationary arrangement of the dishes and flatware, the treatment zones in pass-through dishwashers are arranged in series and the items to be washed or cleaned are conveyed from the entry region, through the successive treatment zones which are to be passed through, to the removal region by means of suitably designed conveyor means.

Pass-through dishwashers known from the prior art have at least four treatment zones between the entry region and the exit region. A conveyor device conveys the items to be washed through the treatment zones. Said zones include a precleaning zone (preclearing area), at least one cleaning zone, a rinsing zone and a drying zone. In the precleaning zone (preclearing area), lightly adhering dirt is removed from the items to be cleaned. To this end, washing liquid is drawn from the reservoir tank associated with this treatment zone by a pump and sprayed over the items to be cleaned through suitably designed nozzles. The washing liquid then flows back into the reservoir tank again and is there again drawn up by a circulation pump and introduced into the circulation circuit. The reservoir tank is usually covered by screens in order to keep relatively large particles of dirt out of the washing liquid.

In the at least one cleaning zone which follows the precleaning zone (preclearing area), particles of dirt which are still adhering to the items to be cleaned are removed by means of a usually alkaline washing liquid. To this end, the heated washing liquid is drawn from the reservoir tank which is associated with the treatment zone by a further circulation pump and sprayed over the items to be washed by means of suitably positioned and oriented nozzles. The washing liquid then flows back into the corresponding reservoir tank again and is there drawn up by the circulation pump again. The reservoir tank is usually covered by screens in order to keep relatively coarse particles of dirt out of the washing liquid.

The generally heated washing liquid produces steam (water vapor) when it is sprayed within the respective treatment zone of the cleaning machine. In this case, it is important to keep the water vapor and therefore its energy content in this treatment zone as far as possible, in order to prevent heat energy being discharged from this zone in this way.

In the rinsing zone which follows the at least one cleaning zone, the alkaline washing liquid which wets the surface of the items to be cleaned, together with any remaining food residues, are rinsed off from the surface of the items to be cleaned by means of hot fresh water to which a rinse aid is generally added. In specific embodiments of the rinsing zone, the fresh water is once again captured in a reservoir tank associated with this treatment zone after this treatment step and drawn up by a circulation pump associated with this treatment zone and distributed over the items to be washed by means of nozzles before the actual rinsing process using fresh water. The washing liquid then flows back into the reservoir tank again and is there drawn up by the circulation pump again. The increased temperature of the heated water and the fine spraying by means of the spray nozzles likewise produce steam (water vapor) in this zone. Analogously to the at least one cleaning zone, it is likewise important here to keep the water vapor and therefore its energy content in the respective treatment zone, in this case the rinsing zone, as far as possible, in order to prevent heat energy being discharged from this zone in this way.

High-energy steam (water vapor) and moist, warm air which are conducted within the cleaning machine to at least one device for heat recovery and are then discharged from the machine are produced during the washing process in the washing liquid-bearing process steps.

In the drying zone, which follows the rinsing zone, heated air is blown onto the items which have been washed via discharge nozzles by means of a fan. The fans are designed in such a way that high air speeds can be produced at the discharge nozzle. As a result, the washing liquid which remains on the items which have been washed is removed from the items which have been cleaned partly by being blown off and partly by evaporation. Ideally, the heated air should be circulated in the drying zone and undesirable air streams toward the adjacent zone, in particular the rinsing zone and the exit region or the removal region of the cleaning machine, should be avoided. These streams can be influenced by the type of item being washed itself and the configuration of the drying zone. The air stream is usually kept within the drying zone by air-deflection troughs which are arranged within the conveyor means. The conveyor means is, for example, a continuous conveyor belt which conveys the items to be cleaned through the above-described treatment zones of the cleaning machine continuously or with the inclusion of conveying intervals.

The air stream which is discharged from the discharge nozzle of the fan strikes the air-deflection troughs, which are formed underneath the conveyor means, and divides the air stream substantially into a partial stream which is directed toward the entry region and into a partial stream which is directed toward the exit region of the cleaning machine. The usually U-shaped air-deflection trough deflects the two partial streams upward and guides them back to the fan again, in order to there be drawn up again and blown over the items which have been washed. Since the circulated air in the drying zone absorbs the moisture from the items which have been cleaned and as a result is more moist and therefore less able to absorb further moisture, some of said air has to be replaced by fresh air from the surroundings. This is achieved by a stream being generated in the direction of a suction-extraction point within the cleaning machines by suitable apparatuses, and a partial quantity of air being removed from the machine. At the same time, fresh air flows into the drying zone and replaces a portion of the air circulated in the drying zone.

DE 10 2004 003 797 A1, which corresponds to U.S. Publication No. 2007/0131260 discloses a pass-through dishwasher with a plurality of treatment zones. The flow direction of the discharge air within the cleaning machines runs from the exit to the entry, counter to the conveying direction of the items to be washed through the dishwasher, with the suction-extraction point being arranged in the area of the entry region of the dishwasher. The volumes of air which can be with-drawn from the drying zone can be changed by adjustable positioning of discharge nozzles of the fan of the drying zone.

The machines known from the prior art are designed in such a way that the air-deflection troughs and the air streams produced as a result are designed for a specific, preferably ideal, operating state. This ideal operating state is achieved only when the items to be washed, for example plates and trays, are positioned perpendicularly in the conveyor medium provided for them, the preferably employed conveyor belt, since the air conveyed by the fan can strike the air-deflection trough located beneath the conveyor medium and then guide said air back to the fan only in this state.

However, when not in the abovementioned operating state, which corresponds to the ideal operating state, special operating states are possible, in which, for example, containers, trays which are horizontal on the conveyor medium, or long, flat items to be washed, are conveyed through the various treatment zones of the pass-through dishwasher in order to be cleaned. These special operating states can occur at irregular intervals during the normal operating state. Relatively long items to be cleaned entirely or partially cover the air-deflection trough located beneath the conveyor means when the items which have been cleaned are conveyed through the drying zone. As a result, the function of the air-deflection trough, namely of circulating the air, is entirely or partly blocked. When the air stream which is discharged at high speed by the fan strikes the items which have been cleaned and are located beneath it, for example containers or horizontal trays, said air stream splits into partial streams which are directed toward the exit (point at which the items which have been cleaned are removed from the conveyor belt) and/or toward the zone adjacent to the drying area, that is to say the rinsing zone.

One partial stream, which is directed toward the rinsing area, produces an air stream through the entire pass-through dishwasher in the direction of the entry region of the cleaning machine and allows high-energy, warm and moist air and also steam (water vapor) to be discharged at the entry region. This means that the climate in the room in which the cleaning machine is installed is adversely affected since the humidity in said room increases.

The other partial stream, which is directed toward the exit region of the cleaning machine, has the disadvantageous effect that high-energy, warm, moist air flows out of the drying zone toward the removal section for the items which have been cleaned, that is to say flows into the room in which the cleaning machine is installed, and has an adverse effect on the climate of the room by increasing the humidity. In addition, water vapor, that is to say steam, can flow into the drying zone from the rinsing zone. This is accompanied by the disadvantage that a great deal of moisture is introduced into the drying zone and into the air circulating within the drying zone. This in turn leads to considerable deterioration in the drying result for the next item which has been cleaned.

The solution outlined above, which makes use of air-deflection troughs, has the disadvantage that energy is discharged from the pass-through dishwasher during temporarily occurring special operating states, for example when containers are conveyed on the preferably continuous conveyor medium or trays lie horizontal on the continuous conveyor medium, on account of the discharge of water vapor, that is to say steam. For the operator of such pass-through dishwashers, this means a resulting increased energy requirement in order to cover the energy losses. In addition, the operating personnel in the entry region, that is to say the region in which the preferably continuous conveyor medium is loaded, and in the removal region, that is to say when the items which have been cleaned are removed from the continuous conveyor medium, are subjected to increased exposure to the high-energy water vapor which is discharged.

SUMMARY OF THE INVENTION

In view of the outlined disadvantages of the prior art, the present invention is based on the object of forming the drying zone of a cleaning machine, in particular a pass-through dishwasher, such that only small or no undesired air streams, and therefore high-energy steam (water vapor), reach adjacent treatment zones and/or the room in which the cleaning machine, which is preferably a pass-through dishwasher, is installed, on account of special operating states.

In accordance with the solution proposed according to the invention, the rotation speed of the fan, which circulates air within the drying zone, is controlled as a function of the operating state created by the item which has been cleaned and is respectively located in the drying zone.

The advantages which can be achieved with the solution proposed according to the invention are primarily that the high-energy steam (water vapor) and therefore warm, moist air cannot escape or can escape only to a minor extent through the entry region and/or the exit region of the cleaning machine, which is preferably a pass-through dishwasher, by virtue of the reduction in the rotation speed of the fan of the drying zone in the event of a special operating state arising. In addition, the reduction in the rotation speed of the fan within the drying time has the effect that the air stream in the drying zone can be better circulated. This has the advantageous effect that no steam (water vapor) or only a small amount of steam (water vapor) can enter the drying zone itself from the rinsing zone, which is arranged upstream of the drying zone, and it is therefore ensured that a sufficient amount of dry air, which is able to absorb moisture from the items which are to be dried, is always available within the drying zone.

The control system of the cleaning machine, which is preferably a pass-through dishwasher, is able to identify whether and when there is a special operating state in the sense outlined above. A special operating state may be produced, for example, by containers, trays lying on the conveyor medium, or long items to be washed being conveyed through the cleaning machine in order to be cleaned. This special operating state may occur at irregular intervals, during normal operation as a one-off event or several times in succession. Correspondingly designed sensors, for example moisture sensors, differential pressure switches, flow sensors or the like, identify this special operating state and transmit it to the controller of the cleaning machine. As soon as this special operating state is identified by the machine control system, the rotation speed of the fan and therefore the flow rate and the air volume of the air stream which is discharged at the discharge nozzle of the fan into the drying zone are reduced to a predetermined value which is stored in the machine control system. The smaller air stream, whose flow rate is therefore slowed down, has the advantageous effect of producing smaller partial streams in the direction of the adjacent zones, that is to say the removal region at the end of the pass-through dishwashing machine and/or the rinsing zone, which is arranged upstream of the drying zone, when said air stream strikes the items which are to be cleaned. Since the partial streams which are now discharged have a substantially lower flow rate, it is possible to circulate said streams within the drying zone and therefore prevent said streams escaping from the drying zone into the abovementioned adjacent zones.

Furthermore, the machine control system of the cleaning machine, which is preferably a pass-through dishwasher, is able to identify whether and when the pass-through dishwasher is no longer in a special operating state as a function of the at least one moisture sensor which is mounted in the drying zone and/or at least one temperature sensor which is provided there and/or at least one pressure sensor which is provided there. If the machine control system has identified this state of transition from the special operating state to the normal operating state, the rotation speed of the fan and therefore the speed and the air volume of the air stream of the drying zone, which air stream is discharged at the discharge nozzle of the fan, can again be increased to the value which was set before the reduction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
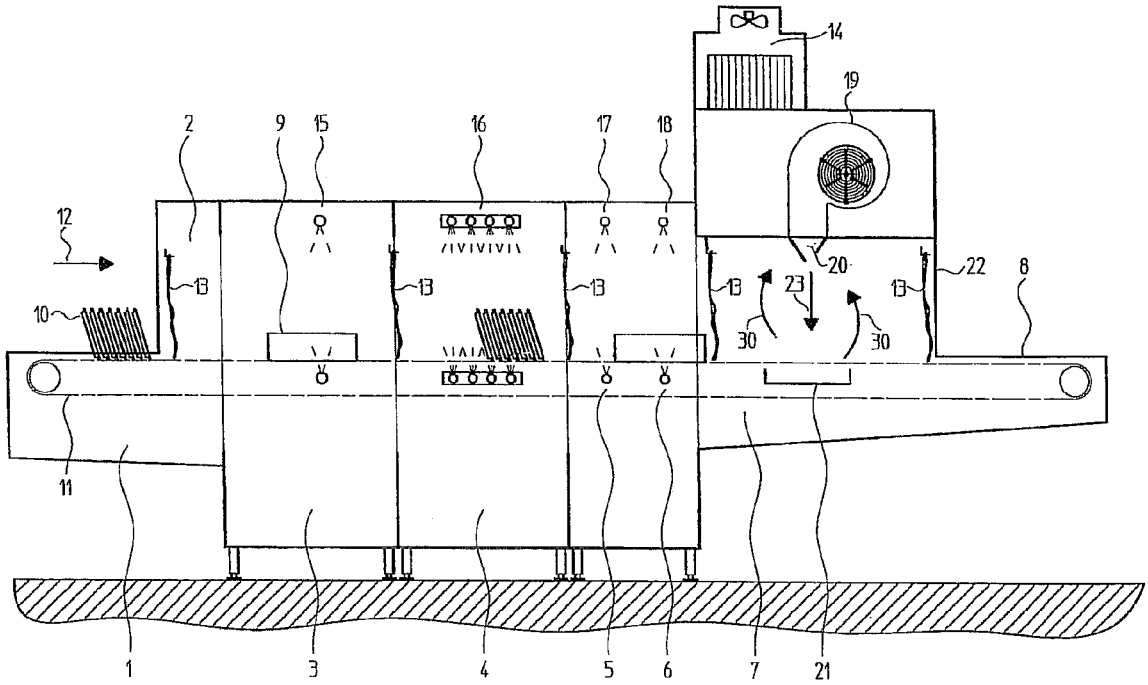
FIG. 1 shows a schematically reproduced illustration of an embodiment of the pass-through dishwasher proposed according to the invention.

The illustration according to FIG. 1 shows a schematically reproduced embodiment of the pass-through dishwasher proposed according to the invention.

In this pass-through dishwasher, different operating states occur at irregular intervals on account of items 9, 10 to be washed of different shapes. The items 9, 10 to be washed are conveyed by means of a conveyor belt 11 in the embodiment of the pass-through dishwasher illustrated in FIG. 1. This conveyor belt 11 is preferably used as a continuous revolving medium in order to convey the items 9, 10 to be washed through various treatment zones of the pass-through dishwasher illustrated in FIG. 1.

Firstly, items 10 to be washed, for example trays and/or plates which are positioned at an angle, which represent a normal operating state are located on the conveyor belt 11. Secondly, items 9 to be washed, for example containers or long items to be washed, which lead to a special operating state of the pass-through dishwasher on account of the respective configuration are likewise located on the conveyor belt.

At an entry 1, items 9, 10 which are to be washed and are held on the upper side of the conveyor belt 11 run into an entry tunnel 2. The entry tunnel 2 is shielded from the outside by means of a partition curtain 13 in order to prevent steam being discharged in the region of the entry 1 of the pass-through dishwasher. After the items 9, 10 which are to be washed, are held on upper side of the conveyor belt 11 and are conveyed in the conveying direction 12 have passed the entry tunnel 2, said items are conveyed into a prewashing zone 3. A prewashing system 15 is arranged within the prewashing zone 3 (preclearing area). This prewashing system 15 has at least one spray pipe, preferably a plurality of spray pipes which are arranged on the lower side or above the revolving conveyor belt 11 in this zone. Cleaning liquid is supplied to the prewashing system 15 by means of a pump (not illustrated in FIG. 1) and sprayed onto the items to be washed by means of the spray pipes and the spray arms. The prewashing zone 3 is separated from a washing zone 4 which follows it by means of a further partition curtain 13.

After the items 9, 10 to be washed have left the prewashing zone 3, they enter a following washing zone 4. The following washing zone 4 also comprises at least one washing system 16 which is arranged above and below the upper side of the revolving conveyor belt 11. The at least one washing zone 4 likewise has an associated pump whose pump power can be variably controlled and by means of which cleaning liquid is supplied to the spray pipes of the washing system 16. The washing zone 4 is separated from a pump-action rinsing zone 5 by a further partition curtain 13 which has a spray system which is arranged above the upper side of the conveyor belt 11 and a spray system which is arranged below the upper side of the conveyor belt 11, in the form of two opposite spray pipes 17. A fresh-water rinsing zone 6 follows the pump-action rinsing zone 5. The items 9, 10 being washed are rinsed off using fresh water within the fresh-water rinsing zone 6 in order to remove any remaining impurities and/or previously applied cleaning fluid from the items 9, 10 being washed before they enter a drying zone 7. A further partition curtain 13 which separates the fresh-water rinsing zone 6 from the drying zone 7 is located downstream of the fresh-water rinsing zone 6. A drying fan 19 is located within the drying zone 7 which has a removal section 8 arranged downstream of it. This drying fan 19 draws air from the drying zone 7 and guides it to a discharge nozzle 20 via a heating device (not illustrated). The air which is heated in the drying fan 19 and the following heating devices is accelerated into the discharge nozzle 20 and directed at high speed in the direction of the cleaned and rinsed items 9, 10 which are passing through the dying zone 7. The lower region of the drying zone 7 contains an air-deflection trough 21 which, in the normal operating state, that is to say when normal items 10 which have been washed are conveyed through the drying zone, deflects the hot air which is discharged from the discharge nozzle 20 in discharge direction 23 in flow direction 30, so that said air again flows to the drying fan 19. As seen in the conveying direction 12, the drying zone 7 is shielded from the removal section 8 by means of a further partition curtain 13. The partition curtains 13 located in the pass-through dishwasher prevent steam (water vapor) and/or splash water entering adjacent zones and/or reaching the feed section 1 or removal section 8. As a result, energy-efficient operation can be achieved in the normal operating state of the pass-through dishwasher since the steam (water vapor) which is at a relatively high temperature can be kept within the respective treatment zones 3, 4, 5, 6 and cannot leave the pass-through dishwasher.

Figure 2:
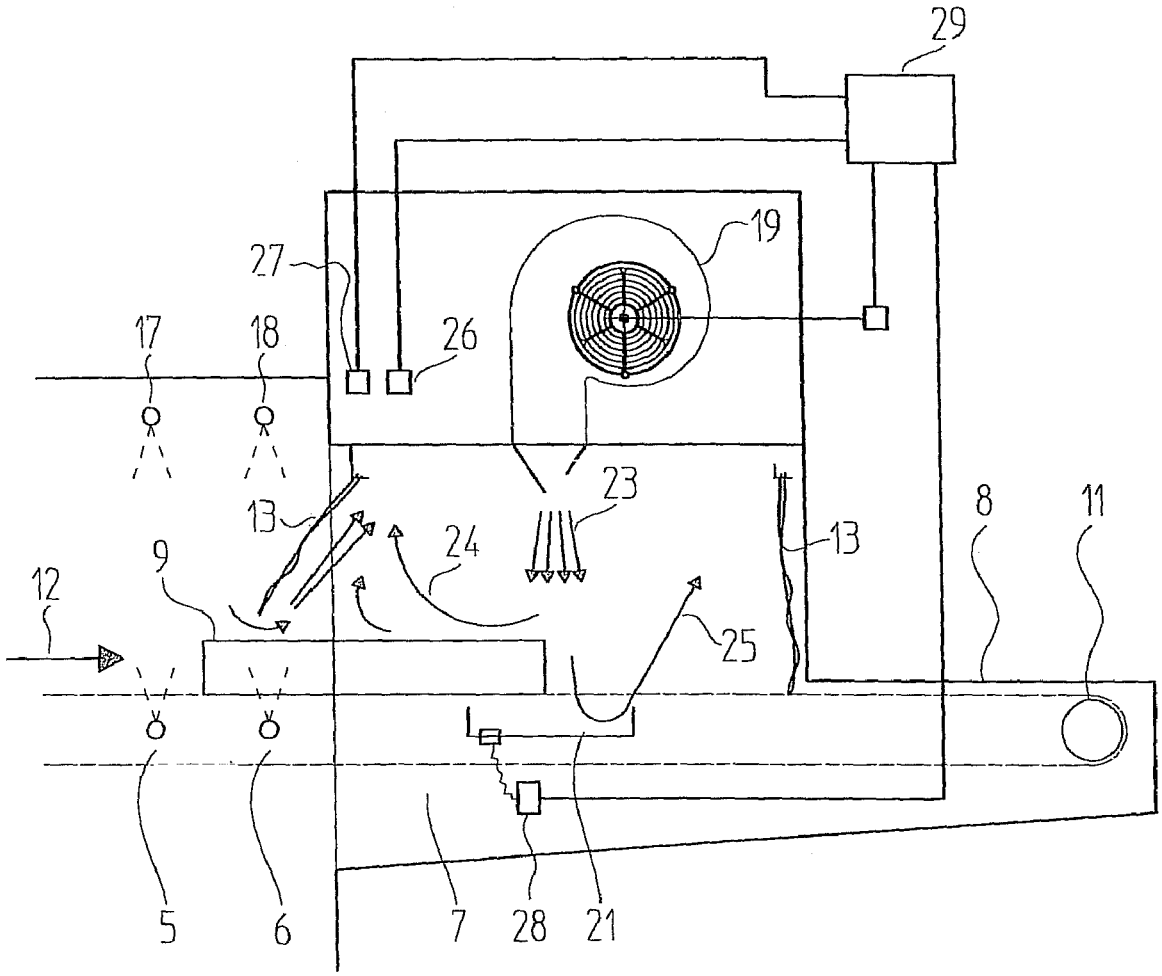
FIG. 2 shows a drying zone in which identification of a special operating state is illustrated.

The illustration according to FIG. 2 shows a special operating state which is created by non-ideal items which have been washed.

The illustration according to FIG. 2 shows that items 9 which have been washed, which are called special items which have been washed in the present case, are conveyed from the fresh-water rinsing zone 6 to the drying zone 7 on the conveyor belt 11 such that they are horizontal in conveying direction 12. On account of the length and the closed surface of the items 9 which have been washed, the air-deflection trough 21 which is located beneath the drying zone 7 is initially partly covered and, after a short conveying time of the special items which have been washed and extend in the longitudinal direction, that is to say in the conveying direction, is completely covered by said items. The air stream 23 which is discharged by the discharge nozzle 20 and strikes the items 9 which have been washed, here representing special items which have been washed, is divided into a first partial stream 24 and a further, second partial stream 25. On account of the still high speed of the first partial stream 24 and the lack of deflection of the partial stream 24 upward, moist, hot air (water vapor) is entrained from the fresh-water rinsing zone 6 into the drying zone 7 which is arranged downstream of said fresh-water rinsing zone. By virtue of sensors which may be, for example, at least one moisture sensor 26 and/or at least one temperature sensor 27 and which are mounted in a suitable position in the drying zone 7, it is possible to inform the machine control system 29 about the increase in temperature and/or humidity in the drying zone caused by the first partial stream 24 in combination with the special items 9 which have been washed. As a function of these signals, the control system 29 can identify the presence of a special operating state in which the power of the fan 19 of the drying zone 7 and therefore the air volume discharged from said fan and the flow rate of the air stream 23 are reduced to a predefined value. If the air stream 23 which is reduced after identification of a special operating state by the machine control system 29 now strikes the special items 9 which have been washed, said air stream splits into a small first partial stream 24 and a smaller second partial stream 25. As a result, the relatively small first and second partial streams 24, 25 can be circulated within the drying zone 7 without steam (water vapor) from the fresh-water rinsing zone 6 being introduced into the drying zone 7 arranged downstream of said fresh-water rinsing zone, even though the air in the deflection trough 21 is covered by the special items 9 which have been washed. A further result is that a sufficient quantity of dry air which is able to absorb moisture both from the normal items 10 which have been cleaned and also from the items 9 which have been washed and are likewise to be dried is always available within the drying zone 7.

In a further embodiment of the drying zone 7 which is arranged downstream of the fresh-water rinsing zone 6, the control system 29 can identify the special operating state which is created by special items 9 which have been washed, for example containers, horizontal trays, long items which have been washed, using a pressure sensor which is mounted in a suitable position, for example in the region of the air-deflection trough 21. When the special items 9 to be washed pass over the air-deflection trough 21, the air stream 23 which is discharged from the discharge nozzle 20 at high speed and extends between the drying zone 19 and the air-deflection trough 21 is interrupted. The resulting pressure difference is detected by the pressure sensor 28 and transmitted to the control system 29. As a function of this pressure difference which is now present in the control system 29, said control system can identify the presence of a special operating state in which the power of the fan 19 of the drying zone 7 and therefore the air volume and the speed of the air stream 23 which is discharged from the drying fan 19 are reduced to a predetermined value which is stored in the control system 29.

The end of the special operating state can be initiated by means of a period of time elapsing and/or the sensors 26, 27, 28 which are mounted in a suitable position in the drying zone 7 and which may be at least one humidity sensor 26, at least one temperature sensor 27 or the at least one pressure sensor 28 mentioned above.

Although the pass-through dishwashing machine according to FIG. 1 is illustrated with a revolving continuous conveyor belt 11 in the illustration, the items 9, 10 to be washed can be passed through the pass-through dishwasher in the conveying direction 12 by using conveyor racks, which are conveyed through the pass-through dishwasher by means of a chain or a ratchet rail, instead of this revolving conveyor, belt 11. The pass-through dishwasher illustrated in FIG. 1 comprises a prewashing zone 3 (preclearing area) and the pump-action rinsing zone 5 which is denoted by reference symbol 5, although neither of these components is absolutely necessary, and the fresh-water rinsing zone 6. It is important for the special operating states to be identified by sensors 26, 27, 28 which are mounted in a suitable position in the drying zone 7 and for the discharge of high-energy and moist steam (water vapor) from the pass-through dishwasher to be prevented by taking corresponding countermeasures, for example regulating the rotation speed of the drying fan 19.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A pass-through dishwasher for cleaning items to be washed, comprising:

at least one washing zone;

at least one rinsing zone;

a drying zone having at least one fan and an air-deflection trough positioned to deflect a jet of air from said fan;

a conveyor device for conveying the items to be washed through the pass-through dishwasher in a conveying direction;

sensors for detecting air streams which are discharged from the drying zone and are directed in or counter to the conveying direction of the items to be washed; and a controller for controlling the rotational speed of the at least one fan based on an output from the sensors, wherein the controller is configured to decrease the fan speed from a first speed to a second speed less than said first speed when the sensors detect a blockage of a path from said fan to said air-deflection trough.

2. The pass-through dishwasher as claimed in claim 1, wherein the sensors are in the form of differential pressure sensors.

3. The pass-through dishwasher as claimed in claim 1, wherein the sensors are in the form of humidity sensors.

4. The pass-through dishwasher as claimed in claim 1, wherein the sensors are designed as temperature sensors.

5. The pass-through dishwasher as claimed in claim 1, wherein the sensors are in the form of air anemometers.

6. The pass-through dishwasher as claimed in claim 1, wherein partial streams, which are discharged from the at least one fan of the drying zone, are circulated within the drying zone.

7. The pass-through dishwasher as claimed in claim 1, wherein the controller identifies an end of the blockage of the path from said fan to said air deflection trough and a discharge speed and/or an air volume at a discharge nozzle of the at least one fan is increased.

8. A pass-through dishwasher for cleaning items to be washed, comprising:

at least one washing zone;

at least one rinsing zone;

a drying zone having at least one fan and an air-deflection trough positioned to deflect a jet of air from said fan;

a conveyor device for conveying the items to be washed through the pass-through dishwasher in a conveying direction; and a controller for controlling a rotational speed of said fan based on an output from a sensor, wherein the controller is configured to decrease the fan speed from a first speed to a second speed less than said first speed when the sensor detects a blockage of a path from said fan to said air-deflection trough.

9. The pass-through dishwasher as claimed in claim 8, wherein said sensor is adapted to produce an output indicative of the blockage when a first type of item passes between the fan and the air-deflection trough and to not produce an output indicative of the blockage when a second type of object passes between the fan and the air-deflection trough.

10. The pass-through dishwasher as claimed in claim 9, wherein the sensor is a differential pressure sensor.

11. The pass-through dishwasher as claimed in claim 9, wherein the sensor is a humidity sensor.

12. The pass-through dishwasher as claimed in claim 9, wherein the sensor is a temperature sensor.

13. The pass-through dishwasher as claimed in claim 9, wherein the sensor comprises an air anemometer.

14. A pass-through dishwasher for cleaning items to be washed, comprising:

at least one washing zone;

at least one rinsing zone;

a drying zone having at least one fan;

a conveyor device for conveying the items to be washed through the pass-through dishwasher in a conveying direction;

sensors for detecting air streams which are discharged from the drying zone; and a controller for controlling a rotational speed of the at least one fan based on an output from the sensors, wherein the rotational speed of the at least one fan of the drying zone is controlled as a function of the items to be washed.

15. The pass-through dishwasher according to claim 14, wherein the function is based on the airflow resistance presented by the items to be washed.

* * * * *

UNITED STATES PATENT AND TRADEMARK OFFICE

CERTIFICATE OF CORRECTION

PATENT NO. : 8,303,728 B2
APPLICATION NO. : 12/105763
DATED : November 6, 2012
INVENTOR(S) : Peukert et al.

It is certified that error appears in the above-identified patent and that said Letters Patent is hereby corrected as shown below:

Title Page, item (75) Inventors: should read as follows: Thomas Peukert ~~Oberkirch~~ Buehl (DE)

Signed and Sealed this
First Day of January, 2013

David J. Kappos

David J. Kappos
*Director of the United States Patent and Trademark Office*